US011600432B2

(12) United States Patent
Cooper

(10) Patent No.: US 11,600,432 B2
(45) Date of Patent: Mar. 7, 2023

(54) SUBSTRATE-EMBEDDED TRANSFORMER WITH IMPROVED ISOLATION

(71) Applicant: Murata Manufacturing Co., Ltd., Nagaokakyo (JP)

(72) Inventor: Matthew Scott Cooper, Milton Keynes (GB)

(73) Assignee: MURATA MANUFACTURING CO., LTD., Kyoto (JP)

( * ) Notice: Subject to any disclaimer, the term of this patent is extended or adjusted under 35 U.S.C. 154(b) by 718 days.

(21) Appl. No.: 16/078,442

(22) PCT Filed: Feb. 22, 2017

(86) PCT No.: PCT/US2017/018842
§ 371 (c)(1),
(2) Date: Aug. 21, 2018

(87) PCT Pub. No.: WO2017/147129
PCT Pub. Date: Aug. 31, 2017

(65) Prior Publication Data

US 2019/0043658 A1 Feb. 7, 2019

Related U.S. Application Data

(60) Provisional application No. 62/299,144, filed on Feb. 24, 2016.

(51) Int. Cl.
*H01F 27/29* (2006.01)
*H01F 27/28* (2006.01)

(52) U.S. Cl.
CPC ..... *H01F 27/292* (2013.01); *H01F 27/2804* (2013.01); *H01F 27/2895* (2013.01); *H01F 2027/297* (2013.01)

(58) Field of Classification Search
CPC ..... H01F 27/292; H01F 27/2804; H01F 27/2895; H01F 2027/297; H01F 41/10; H01F 41/005
See application file for complete search history.

(56) References Cited

U.S. PATENT DOCUMENTS 5,191,699 A 3/1993 Ganslmeier et al.
5,781,091 A 7/1998 Krone et al.
(Continued)

FOREIGN PATENT DOCUMENTS

CN 102159037 A 8/2011
CN 102933040 A 2/2013
(Continued)

OTHER PUBLICATIONS

Official Communication issued in International Patent Application No. PCT/US2017/018842,dated May 31, 2017.

*Primary Examiner* — Tuyen T Nguyen
(74) *Attorney, Agent, or Firm* — Keating & Bennett, LLP

(57) ABSTRACT

An embedded-core device including a substrate, a core embedded in the substrate, a winding arranged around the core, and a dummy pin in direct contact with the core and not in direct contact with the winding. A method of a manufacturing an embedded-core device includes providing winding pins and a dummy pin, inserting a core between the winding pins using the dummy pin such that the dummy pin is in direct contact with the core and not in direct contact with the winding pins, and sealing the core with resin.

11 Claims, 4 Drawing Sheets

(56) References Cited

U.S. PATENT DOCUMENTS

| | | | | |
|---|---|---|---|---|
| 7,489,226 | B1 | 2/2009 | Chignola et al. | |
| 2002/0070831 | A1 | 6/2002 | Harding | |
| 2003/0005569 | A1 | 1/2003 | Hiatt et al. | |
| 2004/0135662 | A1 | 7/2004 | Harding | |
| 2005/0052268 | A1 | 3/2005 | Pleskach et al. | |
| 2006/0152322 | A1 | 7/2006 | Whittaker et al. | |
| 2006/0176139 | A1 | 8/2006 | Pleskach et al. | |
| 2007/0257761 | A1 | 11/2007 | Mano et al. | |
| 2008/0007382 | A1 | 1/2008 | Snyder | |
| 2008/0117607 | A1 | 5/2008 | Murayama et al. | |
| 2008/0129436 | A1* | 6/2008 | Feist | H01F 27/027 336/208 |
| 2009/0002111 | A1 | 1/2009 | Harrison et al. | |
| 2009/0237899 | A1 | 9/2009 | Furnival | |
| 2011/0108317 | A1 | 5/2011 | Harrison et al. | |
| 2011/0193672 | A1 | 8/2011 | Yang | |
| 2011/0242713 | A1 | 10/2011 | Dalmia et al. | |
| 2011/0272094 | A1 | 11/2011 | Dalmia et al. | |
| 2011/0291787 | A1 | 12/2011 | Dalmia et al. | |
| 2012/0212919 | A1 | 8/2012 | Mano et al. | |
| 2015/0061817 | A1 | 3/2015 | Lee et al. | |
| 2016/0372259 | A1 | 12/2016 | Banba et al. | |
| 2017/0084384 | A1* | 3/2017 | Otsubo | H01F 27/2804 |
| 2017/0316858 | A1* | 11/2017 | Otsubo | H01F 5/04 |

FOREIGN PATENT DOCUMENTS

| | | | | |
|---|---|---|---|---|
| CN | 106887299 | A | * | 6/2017 |
| DE | 10 2005 055 869 | A1 | | 5/2007 |
| JP | 10-126054 | A | | 5/1998 |
| JP | 2006-165212 | A | | 6/2006 |
| JP | 2014-038884 | A | | 2/2014 |
| TW | 201201640 | A1 | | 1/2012 |
| WO | 98/56016 | A1 | | 12/1998 |
| WO | 2010/065113 | A1 | | 6/2010 |
| WO | 2010/097387 | A1 | | 9/2010 |
| WO | 2011/014200 | A1 | | 2/2011 |
| WO | 2015/133361 | A1 | | 9/2015 |

* cited by examiner

SUBSTRATE-EMBEDDED TRANSFORMER WITH IMPROVED ISOLATION

BACKGROUND OF THE INVENTION

1. Field of the Invention

The present invention relates to substrate-embedded transformers. More specifically, the present invention relates to substrate-embedded transformers with improved isolation.

2. Description of the Related Art

It is known to embed a transformer in a substrate. FIG. 1 shows an embedded-core device 1*a* that includes a core 3 embedded in a substrate 2. The substrate 2 includes through holes 4. Pins 5*a*1-5*a*12, 5*b*1-5*b*12 are located in the holes 4. Pins 5*a*1-5*a*12 (with the inner pins collectively referred to as inner pins 5*a*) are located in the substrate 2 in the center of the core 3, and pins 5*b*1-5*b*12 (with the outer pins collectively referred to as outer pins 5*b*) are located in the substrate 2 outside of the core 3. Collectively, the inner pins 5*a* and the outer pins 5*b* are referred to as pins 5. Conductors 6 extend along the top of the embedded-core device 1*a*, and conductors 7 extend along the bottom of the embedded-core device 1*a*. Conductors 6, 7 connect the pins 5 to define a coil. Terminals 10*a*, 10*b* extend along the bottom surface of the embedded-core device 1*a* and are connected to the coil. Although not shown in FIG. 1, an additional coil (or winding) can be added to provide a transformer.

In an embedded transformer, the core must be insulated from the conductive pins. In FIG. 1, the conductive pins correspond to the pins 5. If the core touches the conductive pins, then the turns of the windings of the transformer could be shorted.

The core must be insulated from the conductive pins with significant spacing, depending on the dielectric strength of a molding compound. If the core is too close and touches the conductive pin, then the isolation could break down.

The core is typically made of a ferrite material. Ferrite material is a conductor for UL safety approval purposes. A significant safety barrier must be provided for isolated transformers.

To provide sufficient isolation, it is known to use a core cover or to coat the core with insulation material. The core cover is made from a plastic pre-formed cup and lid, and the ferrite core is inserted into the cup and the lid is attached. Alternatively, the core could be dipped in a polymer material that completely covers the core.

SUMMARY OF THE INVENTION

To overcome the problems described above, preferred embodiments of the present invention provide an embedded transformer in which the core does not touch the pins so that no turns are shorted and in which the core is adequately spaced away from the pins.

According to a preferred embodiment of the present invention, an embedded-core device includes a substrate, a core embedded in the substrate, a winding arranged around the core, and a dummy pin in direct contact with the core and not in direct contact with the winding.

The embedded-core device further preferably includes at least one additional dummy pin in direct contact with the core and not in direct contact with the winding.

The dummy pin preferably includes an inductor or an insulator.

The winding preferably includes winding pins embedded in the substrate. The dummy pin is preferably shorter than the winding pins. The cross-section of the dummy pin is preferably smaller than a cross-section of each of the winding pins. The dummy pin and the winding pins are preferably made of the same material. Preferably, the winding further includes first conductors located on a top surface of the substrate and connected to corresponding winding pins and second conductors located on a bottom surface of the substrate and connected to corresponding winding pins.

The embedded-core device preferably further includes an additional winding. The winding and the additional winding preferably define a transformer.

According to a preferred embodiment of the present invention, a method of a manufacturing an embedded-core device includes providing winding pins and a dummy pin, inserting a core between the winding pins using the dummy pin such that the dummy pin is in direct contact with the core and not in direct contact with the winding pins, and sealing the core with resin.

Preferably, the step of providing winding pins and a dummy pin includes, providing a release sheet with a supporting layer and inserting the winding pins and the dummy pin into the supporting layer. The supporting layer and the release sheet are preferably made of the same material. The method preferably further includes removing the release sheet after the step of sealing the core.

The method preferably further includes forming a winding around the core using the winding pins. The step of forming a winding preferably includes forming conductors that are located on either an upper surface or a lower surface of the embedded-core device and that connect corresponding winding pins. The step of forming a winding preferably includes polishing upper and lower surfaces of the embedded-core device to expose ends of the winding pins. The method preferably further includes forming an additional winding around the core using the winding pins. The winding and the additional winding preferably define a transformer.

The step of providing winding pins and a dummy pin preferably includes providing at least one additional dummy pin.

The above and other features, elements, characteristics, steps, and advantages of the present invention will become more apparent from the following detailed description of preferred embodiments of the present invention with reference to the attached drawings.

DETAILED DESCRIPTION OF PREFERRED EMBODIMENTS

Figure 1:
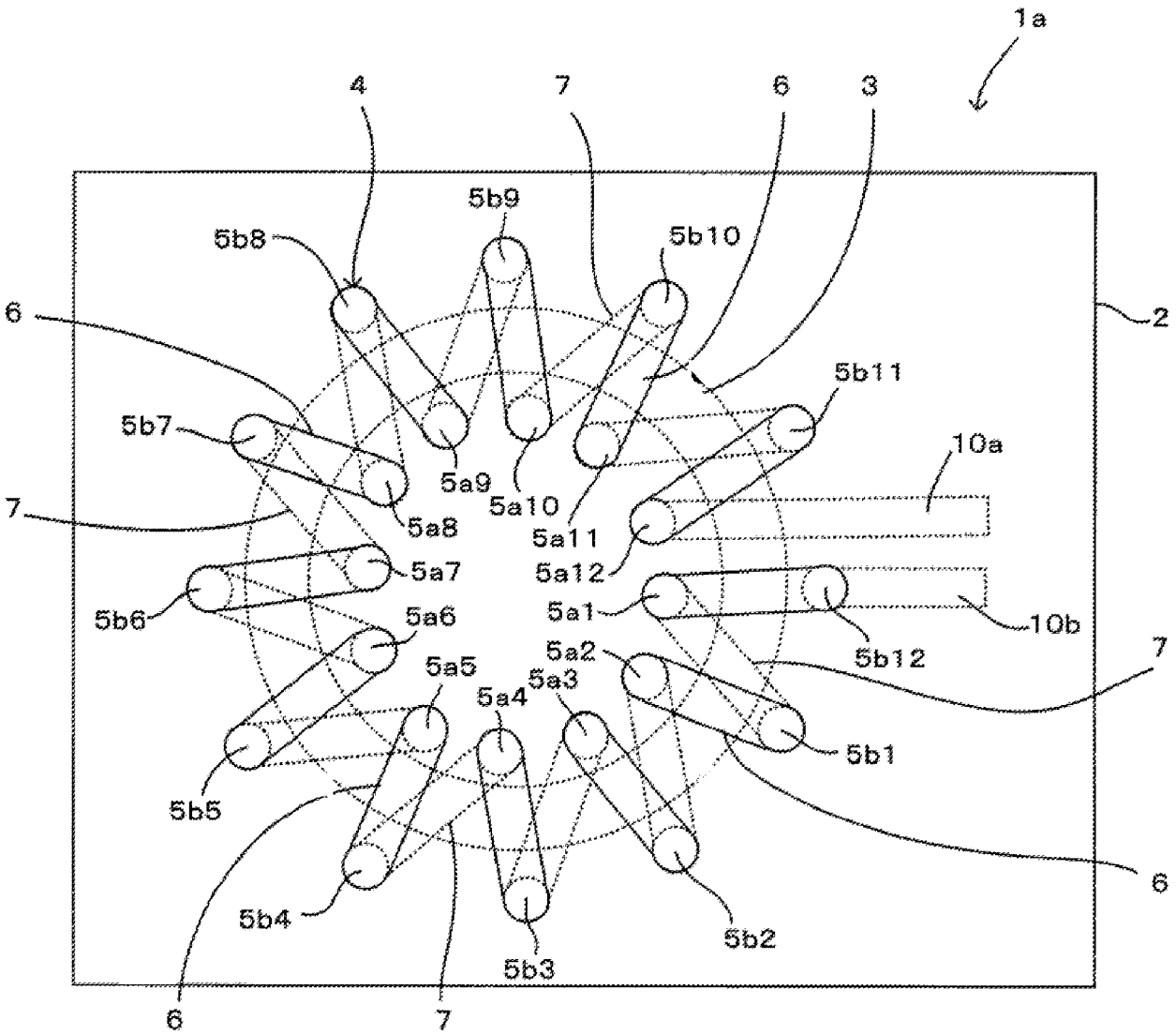
Fig. 1 Prior Art
FIG. 1 shows a known embedded-core device.
Figure 2:
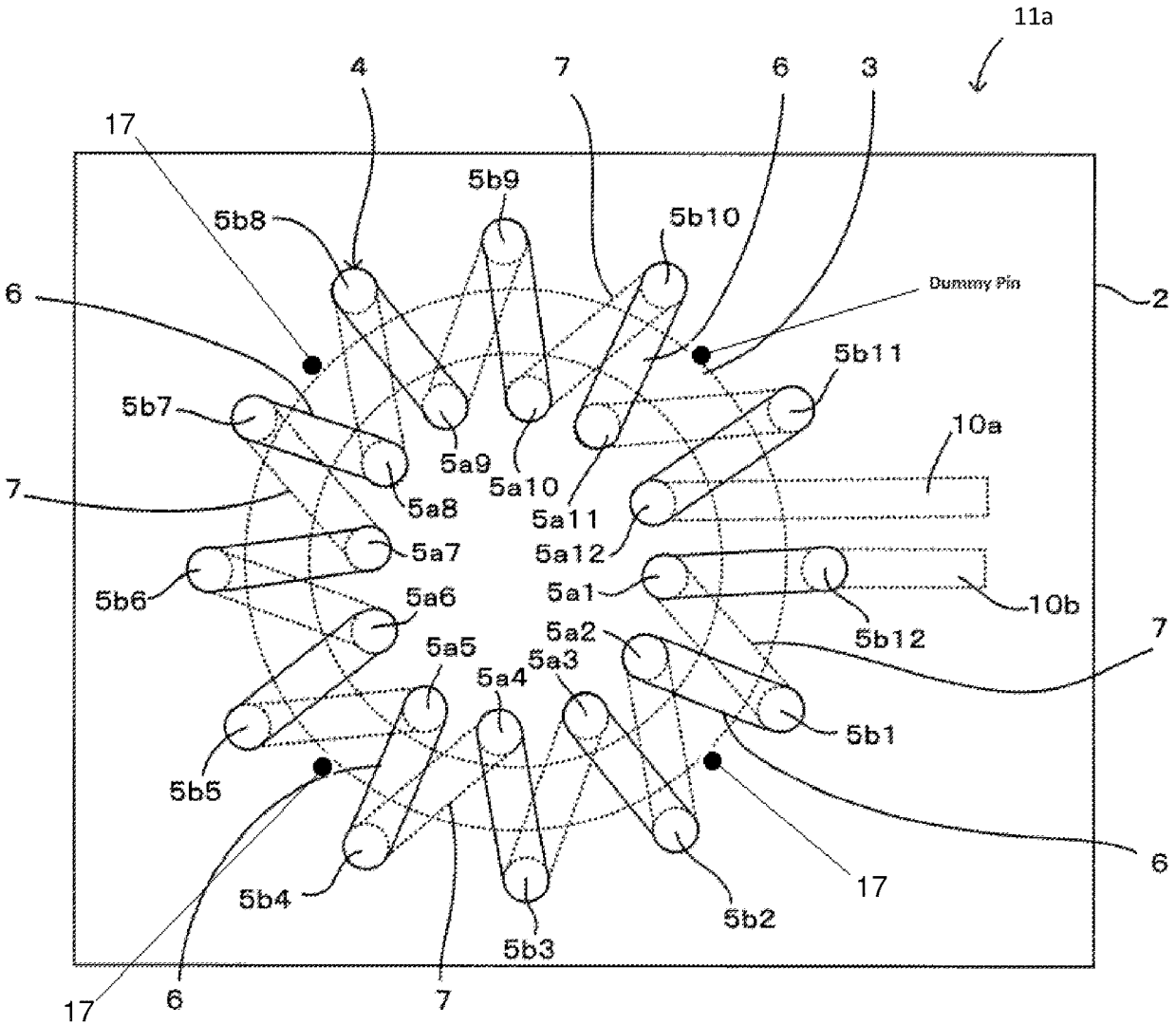
FIG. 2 shows an embedded-core device according to a preferred embodiment of the present invention.

The embedded-core device 11*a* of FIG. 2 is similar to the embedded core device 1*a* of FIG. 1, except that the embedded-core device 11*a* includes dummy pins 17. In FIG. 1, the dummy pins 17 are arranged preferably along the outer radius of the core 3, but it is also possible for the dummy pins 17 to be arranged along the inner radius of the core 3 instead of, or in addition to, the dummy pins 17 arranged along the outer radius of the core 3. In FIG. 2, four dummy pins 17 are preferably provided, for example. However it is possible to use any number of dummy pins 17.

The dummy pin or pins 17 are used to hold the core 3 in place while the coil is molded. The embedded-core device 11*a* can include the features and can be made using the techniques discussed in WO 2015/133361, the entire contents of which are hereby incorporated by reference. Because the dummy pin or pins 17 hold the core 3 in place while the coil is molded, the core 3 does not touch the pins 5 so that no turns of the coil are shorted, and adequate spacing between the core 3 and the pins 5 is ensured. The dummy pin or pins 17 are not electrically connected to the pins 5 that define a portion of the coil. The dummy pin or pins 17 are typically not electrically connected to any other structure. The dummy pin or pins 17 are located closer to the inner and/or outer radius of the core 3 than the pins 5.

The dummy pin or pins 17 be can be made of a conductor or an insulator. The dummy pin or pins 17 can be shorter than the pins 5 that define the coil, if required. The dummy pin or pins 17 can have any shape and do not need to be round. As shown in FIG. 2, the cross-section of the dummy pins 17 can be smaller than the cross-section of the pins 5; however, the cross-section of the dummy pins 17 can be any size compared to the cross-section of the pins 5. It is preferable that the pins 5 and dummy pins 17 be made of the same material and made in a similar manner; however, this is not a requirement.

First, pins 5 are prepared by shearing a metal wire rod to a predetermined length to form a columnar prism or a cylinder. The metal wire rod preferably has a circular or polygonal cross-section. Dummy pins 17 are preferably prepared in a similar manner by shearing a wire rod to the predetermined length. The wire rod for the dummy pins 17 is preferably a metal wire rod, but an insulating wire rod could also be used. The metal wire rod for the pins 5 and the wire rod for the dummy pins 17 can be the same material or different materials, can have the same or different cross-sectional diameter, and can have the same or different cross-sectional shape.

Figure 3:
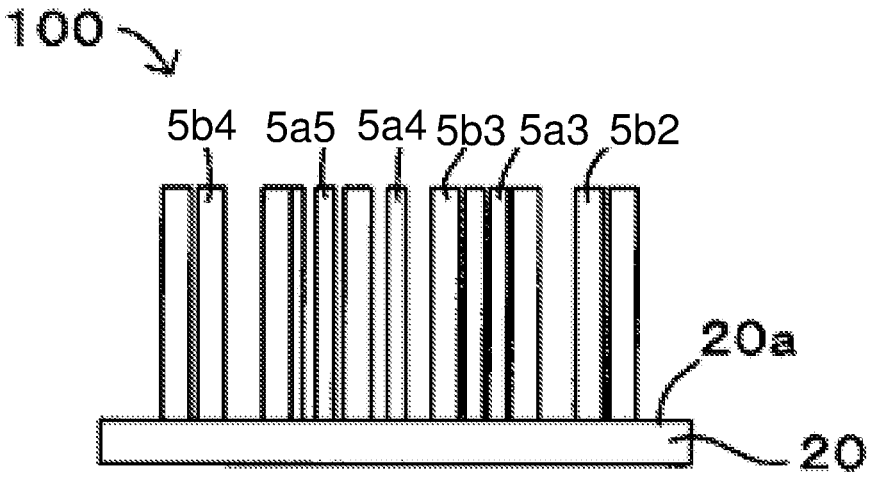
FIGS. 3-6 show a method of manufacturing the embedded-core device of FIG. 2.

A terminal assembly 100 is then prepared as shown in FIG. 3. The terminal assembly 100 includes a transfer member 20 from which pins 5 extend from surface 20*a*. The transfer member 20 can be a plate-shaped member made of a resin material such as glass epoxy resin. The transfer member 20 can include a retention layer that includes an adhesive on surface 20*a*. The retention layer can be made of any suitable resin material, including thermoplastic epoxy or acrylic resin.

Pins 5 and dummy pins 17 can be arranged to extend from surface 20*a* of the transfer member 20. FIG. 3 shows pins 5 arranged on the transfer member 20 before the dummy pins 17 are arranged on the transfer member 20. However, the dummy pins 17 can be arranged on the transfer member 20 in any suitable manner, including before, after, or at the same time as the pins 5. The inner pins 5*a* and outer pins 5*b* are arranged concentrically and away from the region where the core 3 will be located to ensure isolation from the core 3. The dummy pins 17 are preferably arranged in a circle and close to the region where the core 3 will be inserted to support the core 3 when the core 3 is inserted into this region. The dummy pins 17 are preferably arranged diagonally to support at least four points of the core 3. Additional dummy pins 17 can also be arranged concentrically along the inner circumference of the region where the core 3 will be inserted.

Figure 4:
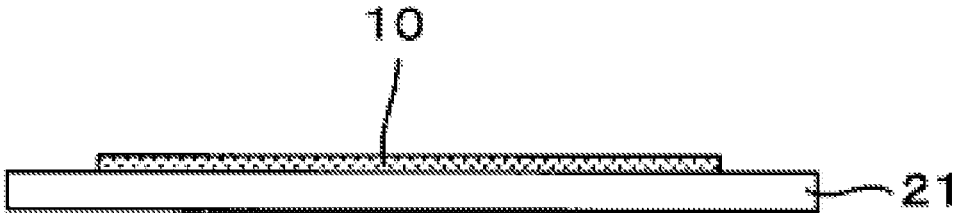

As shown in FIG. 4, a release sheet 21 is prepared on which a supporting layer 10 is formed. The supporting layer 10 is preferably made of thermosetting resin, for example.

Figure 5:
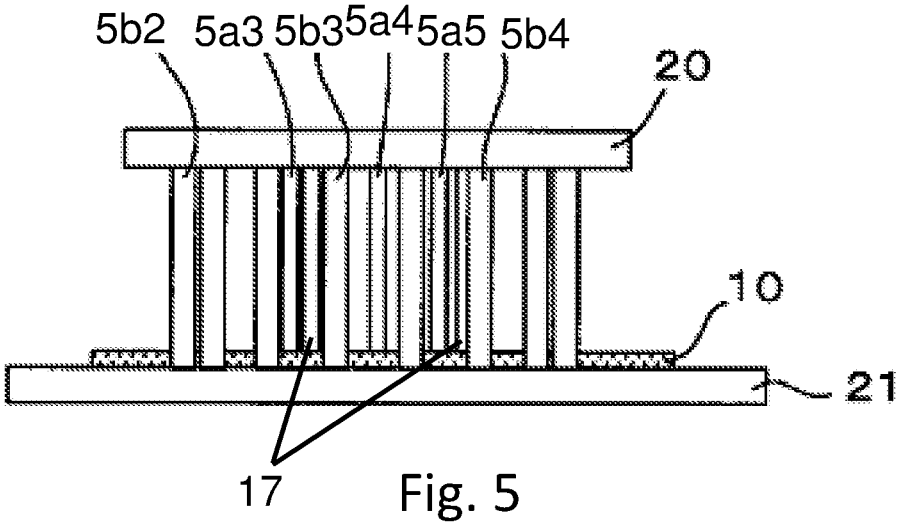
Figure 6:
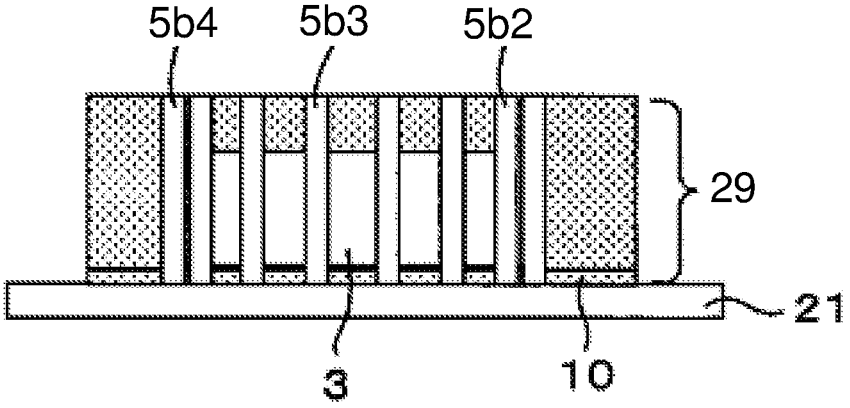

As shown in FIG. 5, first ends of the pins 5 are inserted into the supporting layer 10, and then the supporting layer 10 is heated and hardened. Then, the transfer member 20 is removed, and the core 3 is inserted between the inner pins 5*a* and the outer pins 5*b*, guided by the dummy pins 17. As shown in FIG. 6, a resin insulation layer 29 is formed by sealing the core 3, the metal pins 5, and the dummy pins 17 by a resin material, which is preferably the same as used for the supporting layer 10 but which could be a different material.

The release sheet 21 is then removed. The top and bottom surfaces of the terminal assembly 100 are polished to expose the tops and bottoms of pins 5.

The traces 6, 7 can then be formed on the top and bottom surfaces of the terminal assembly 100 to connect metal pins 5*a*, 5*b* to form a winding. One winding forms a coil, while two windings can form a transformer. The traces 6, 7 can then be plated.

The dummy pins 17 are not connected to the traces 6, 7. The dummy pins 17 could be connected to structures other than the traces 6, 7, such as ground planes. If the dummy pins 17 are made of high heat conductive material such as Au, Ag, or Cu, the dummy pins 17 can provide heat dissipation. The diameter of the dummy pins 17 can be wider than the diameter of the pins 5 to increase heat conductivity.

The dummy pins 17 could be shorter than the pins 5 so that first ends of the dummy pins 17 are buried in the resin insulation layer 29, even after polishing. If the dummy pins 17 are made of a conductive material and if the end or ends of the dummy pins 17 are exposed, the first ends of the dummy pins 17 can be also plated to leave some plated portions on the surfaces of the embedded-core device 11*a*. Having first ends of the dummy pins 17 buried in the resin insulation layer 29 and/or plating the exposed ends of conductive dummy pins 17 can reduce or prevent humidity from entering the embedded-core device 11*a* at the boundary between the dummy pins 17 and the resin insulation layer 29.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. An embedded-core device comprising:

a substrate;

a core embedded in the substrate;

a winding arranged around the core; and a dummy pin in direct contact only with a side surface of the core and not in direct contact with the winding.

2. The embedded-core device of claim 1, further comprising at least one additional dummy pin in direct contact with the core and not in direct contact with the winding.

3. The embedded-core device of claim 1, wherein the dummy pin includes an inductor or an insulator.

4. The embedded-core device of claim 1, wherein the winding includes winding pins embedded in the substrate.

5. The embedded-core device of claim 4, wherein the dummy pin is shorter than the winding pins.

6. The embedded-core device of claim 4, wherein a cross-section of the dummy pin is smaller than a cross-section of each of the winding pins.

7. The embedded-core device of claim 4, wherein the dummy pin and the winding pins are made of a same material.

8. The embedded-core device of claim 4, wherein the winding further includes:

first conductors located on a top surface of the substrate and connected to corresponding winding pins; and second conductors located on a bottom surface of the substrate and connected to corresponding winding pins.

9. The embedded-core device of claim 1, further comprising an additional winding.

10. The embedded-core device of claim 9, wherein the winding and the additional winding define a transformer.

11. The embedded-core device of claim 1, wherein the dummy pin directly contacts the side surface of the core along an entire height of the side surface of the core.

* * * * *